US005996315A

United States Patent [19]

Scherer et al.

[11] Patent Number: 5,996,315

[45] Date of Patent: Dec. 7, 1999

[54] GANTRY FILM WRAPPING SYSTEM AND METHOD FOR WRAPPING ELONGATED LOADS

[75] Inventors: Philip G. Scherer, Fort Lauderdale; Werner K. Diehl, Parkland, both of Fla.

[73] Assignee: Mima, Inc., Glenview, Ill.

[21] Appl. No.: 08/707,005

[22] Filed: Sep. 3, 1996

[51] Int. Cl.[6] ..... B65B 11/04

[52] U.S. Cl. ..... 53/399; 53/465; 53/588; 53/210; 53/211

[58] Field of Search ..... 53/399, 465, 210, 53/211, 588, 214, 215

[56] References Cited

U.S. PATENT DOCUMENTS

| | | | |
|---|---|---|---|
| 4,109,445 | 8/1978 | Schulman . | |
| 4,173,108 | 11/1979 | Eglinton et al. . | |
| 4,281,500 | 8/1981 | Mueller et al. . | |
| 4,362,001 | 12/1982 | Cockerham et al. . | |
| 4,565,051 | 1/1986 | Back . | |
| 4,722,170 | 2/1988 | Ball et al. . | |
| 4,912,911 | 4/1990 | Down . | |
| 5,048,271 | 9/1991 | Walton . | |
| 5,140,795 | 8/1992 | Steding . | |
| 5,195,301 | 3/1993 | Martin-Cocher et al. . | |
| 5,203,139 | 4/1993 | Salsburg et al. . | |
| 5,477,658 | 12/1995 | Berger et al. | 53/399 |
| 5,628,167 | 5/1997 | Huson et al. | 53/465 |

FOREIGN PATENT DOCUMENTS

| | | | |
|---|---|---|---|
| 289784 | 11/1988 | European Pat. Off. | 53/588 |
| 0484029 | 5/1991 | European Pat. Off. . | |
| 2756850 | 6/1978 | Germany . | |
| 4137448 | 5/1993 | Germany . | |
| 2121751 | 1/1982 | United Kingdom . | |
| 2200887 | 8/1988 | United Kingdom . | |

OTHER PUBLICATIONS

ITW Mima, "Guide to Semiautomatic Programmable Platform Stretch Wrappers for Large Cylindrical Loads", Bulletin No. 187, 1987, 4 pages.

*Primary Examiner*—Linda Johnson
*Attorney, Agent, or Firm*—Schwartz & Weinrieb

[57] ABSTRACT

A gantry film wrapping system and method useable for wrapping film about an elongated load. The system includes an overhead frame with first and second lateral support members for supporting opposing end portions of a carriage, which is reciprocatably translatable back and forth along the first and second lateral support members. A film wrapping apparatus having a rotary arm is coupled to the carriage, and a film wrapping carriage is coupled to a dependent member extending from an end portion of the rotary arm. The rotary arm and film wrapping carriage are rotatable in approximately 180 degree rotational increments between and during back and forth translations of the carriage along the first and second lateral support members of the overhead frame, wherein the film wrapping carriage is orbital in a substantially oval orbit about an elongated load disposed below the overhead frame.

17 Claims, 3 Drawing Sheets

GANTRY FILM WRAPPING SYSTEM AND METHOD FOR WRAPPING ELONGATED LOADS

CROSS REFERENCE TO RELATED APPLICATIONS

The present application is related to U.S. application Ser. No. 08/502,130 entitled "Method and Apparatus for Wrapping Elongate Load Having Generally Circular or Generally Annular Ends" filed on Jul. 13, 1995 and assigned to the assignee the present invention, now U.S. Pat. No. 5,628,167.

FIELD OF THE INVENTION

The present invention relates generally to overhead film wrapping systems and methods useable for wrapping elongated loads having a major dimension and a minor dimension, and more particularly to a film wrapping system and method that includes a film wrapping carriage supported by a carriage reciprocatably translatable along an overhead frame and movable in a substantially oval orbit about an elongated load.

BACKGROUND OF THE INVENTION

A variety of systems exist for wrapping shrink or stretch films about elongated loads including textile rolls, rolled paper products, and non-cylindrical loads. The Mima Roll Wrapper™ system available from ITW Mima, Boca Raton Fla., for example, includes a turntable base for rotating elongated cylindrical loads relative to a fixed film wrapping head. The turntable base rotates the load about an axis substantially perpendicular to a major dimension of the load, and also the turntable simultaneously rotates the load about an axis through its major dimension during the film wrapping process so that the load is totally encapsulated by the film. The Mima Horizontal Wrapping Mast™ system also available from ITW Mima, Boca Raton Fla., includes a film wrapping head that translates back and forth along the major dimension of an elongated load as the load is rotated about an axis through its major dimension. In this application, overhanging film material at both ends of the load may be folded over or tied off. This system is useable in combination with a winding machine like a textile winding machine, which forms the elongated load, and is otherwise substantially stationary relative to the translatable film wrapping head.

In other systems, an elongated load is fixed in position relative to a film wrapping head that orbits about the load. The film wrapping head is usually disposed upon an end portion of a rotary arm rotatably mounted in a fixed position above the load. In some load wrapping applications, the load may be rotated about an axis through its major dimension during the film wrapping process so that film is applied to all surfaces thereof. These features are illustrated and disclosed in U.S. Pat. No. 4,565,051 entitled "Method and Apparatus for Wrapping Cylindrical Articles" issued Jan. 21, 1986 to Back.

In view of the discussion above among other considerations, there exists a demonstrated need for an advancement in the art of wrapping a film about a load.

OBJECTS OF THE INVENTION

It is therefore an object of the invention to provide a novel overhead film wrapping system and method useable for wrapping elongated loads.

It is also an object of the invention to provide a novel overhead film wrapping system and method useable for wrapping elongated loads that is economical and advantageous relative to the prior art.

It is another object of the invention to provide a novel overhead film wrapping system and method useable for wrapping elongated loads with a film wrapping carriage supported by a carriage reciprocally translatable along an overhead frame positioned above the load, wherein the carriage and film wrapping carriage are relatively accurately positionable about the load.

It is another object of the invention to provide a novel overhead film wrapping system and method useable for wrapping elongated loads with a film wrapping carriage supported by a rotary arm rotatable in angular increments between and during reciprocating translations of a carriage supporting the rotary arm along first and second lateral support members.

It is a further object of the invention to provide a novel overhead film wrapping system and method useable for wrapping elongated loads with a film wrapping carriage that orbits in a substantially oval pattern about the load.

It is yet another object of the invention to provide a novel overhead film wrapping system and method useable for wrapping elongated loads with a film wrapping carriage that orbits in a substantially rectangular pattern about the load.

SUMMARY OF THE INVENTION

The present invention is, accordingly, drawn to a gantry film wrapping method and system having an overhead frame with first and second lateral support members for supporting opposite end portions of a carriage, which is reciprocatably translatable back and forth along the first and second lateral support members. A film wrapping apparatus having a rotary arm is coupled to the carriage, and a film wrapping carriage is coupled to a dependent member extending downwardly from an end portion of the rotary arm. The rotary arm and film wrapping carriage are rotatable in approximately 180 degree rotational increments between and during back and forth translations of the carriage along the first and second lateral support members of the overhead frame, whereby the film wrapping carriage is orbital in a substantially oval orbit about an elongated load disposed below the overhead frame. According to another mode of operation, the carriage is translated away from a first end portion of the load as the rotary arm moves the film wrapping carriage between approximately 0 degrees and approximately 90 degrees, and the carriage is then translated back toward the first end portion of the load as the rotary arm moves the film wrapping carriage between approximately 90 degrees and approximately 180 degrees, whereby the film wrapping carriage is moved in a substantially rectangular path about the load. According to another aspect of the invention, the system includes a regenerative drive for braking a first rotary drive member as the rotary arm approaches an end of an approximately 180 degree rotational increment, and a brake for positively stopping the first rotary drive member after the rotary arm has rotated through an approximately 180 degree rotational increment.

BRIEF DESCRIPTION OF THE DRAWINGS

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators throughout the several views, and wherein.

DETAILED DESCRIPTION OF THE INVENTION

Figure 1:
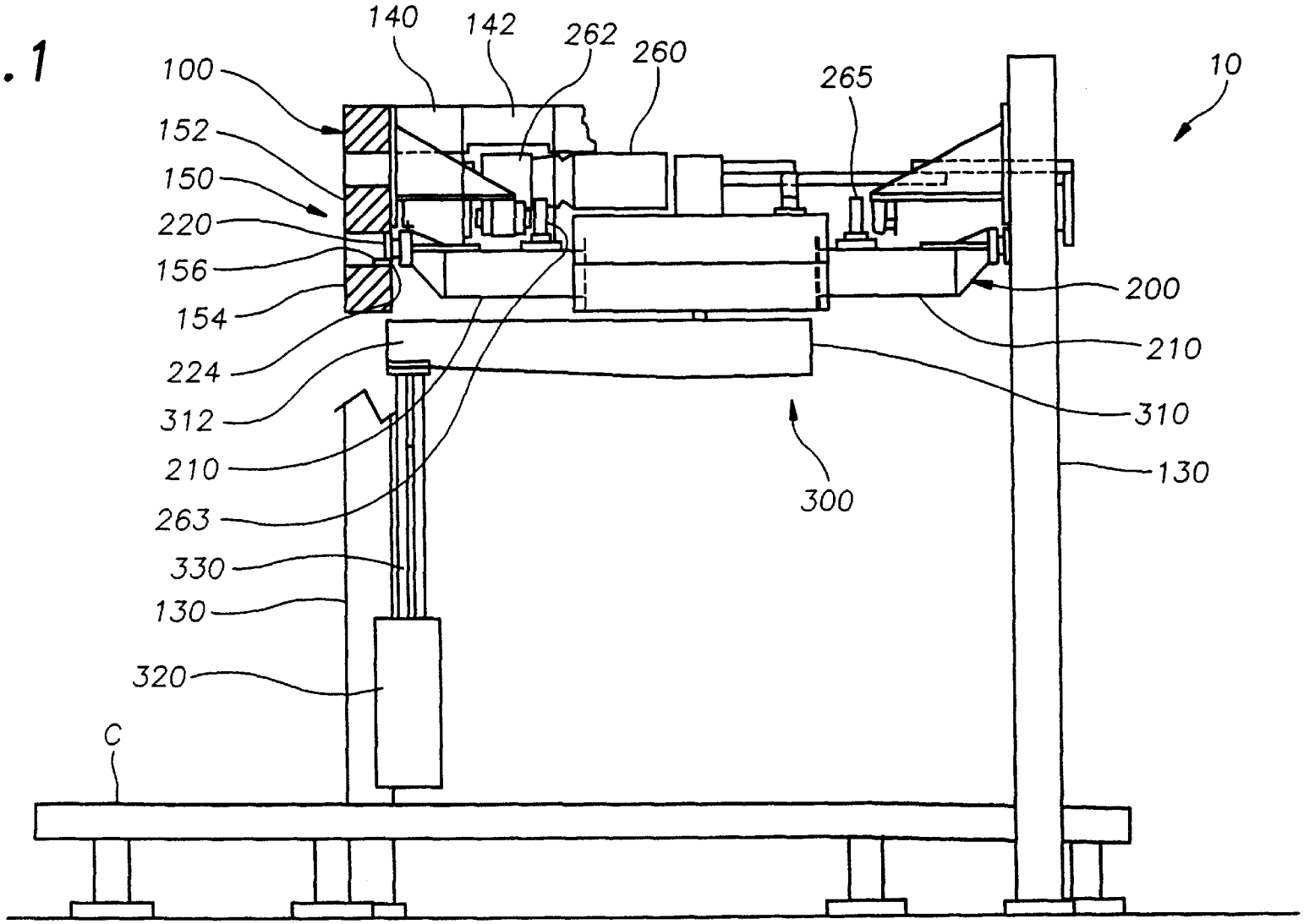
FIG. 1 is a partial elevational view of a gantry film wrapping system according to an exemplary embodiment and suitable for practicing a method of the present invention.
Figure 2:
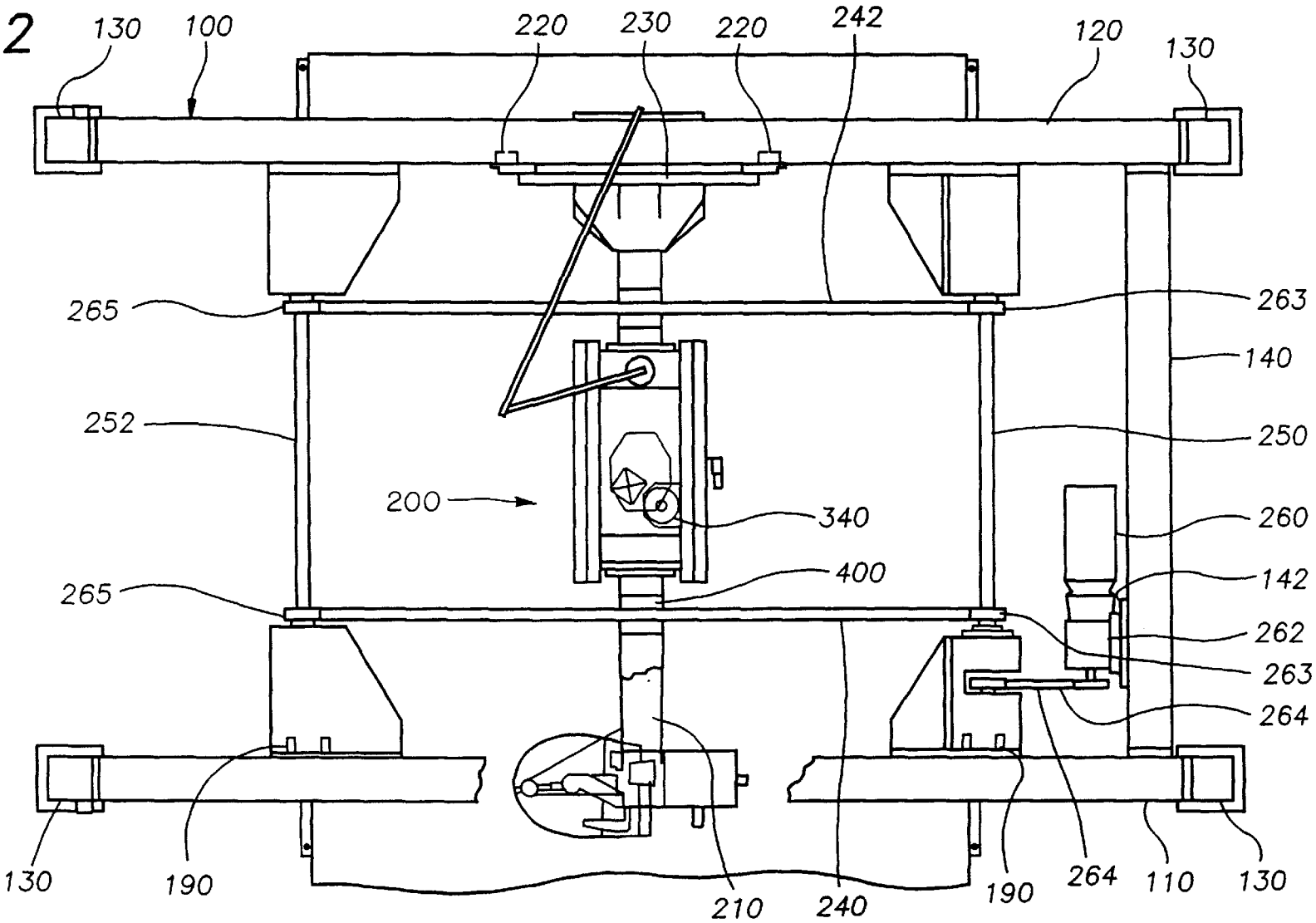
FIG. 2 is a partial plan view of the gantry film wrapping system of FIG. 1.

FIGS. 1 and 2 illustrate a gantry film wrapping system 10 according to an exemplary embodiment of the invention comprising generally an overhead frame 100 supporting a reciprocatably translatable carriage 200, and a film wrapping apparatus 300 coupled to the carriage 200 for wrapping film about an elongated load having major and minor dimensions and first and second opposite end portions, not shown in the drawing. In the exemplary embodiment, the load is positionable below the overhead frame 100 on a conveyor C, and in some applications the load may be oriented below the overhead frame 100 by means known in the art during film wrapping. The load may, for example, be rotated about some axis during the film wrapping process to facilitate encapsulating the entire load with film.

According to one aspect of the invention, the overhead frame 100 includes a first lateral support member 110 and a second lateral support member 120, and in the exemplary embodiment the overhead frame 100 is supported at four corners by upright support members 130, which may be anchored to a floor or other underlying support structure. The upright support members 130 are arranged generally to permit ready positioning of loads along the conveyor C or along other means below the overhead frame 100 for film wrapping as further discussed below. The overhead frame 100 may alternatively be supported from above by an overhead cantilever support member extending from some other support member disposed along side the overhead frame 100, absent the upright support members 130. In the exemplary embodiment, one or more cross members 140 are disposed between the first and second laterals support members 110 and 120 at opposite end portions thereof for additional structural support and for mounting purposes as further discussed below. The cross members 140 may alternatively be disposed between the upright support members 130, or coupled to an overhead cantilever support member.

According to another aspect of the invention, the carriage 200 has opposite end portions each of which is movably supported by one of the first and second lateral support members 110 and 120 so that the carriage 200 is reciprocatably translatable back and forth along the first and second lateral support members 110 and 120 of the overhead frame 100. In the exemplary embodiment, the carriage 200 includes a carriage support member 210 disposed transversely between the first and second lateral support members 110 and 120 wherein at least one roller 220 is rotatably disposed on each opposite end portion of the carriage support member 210. In the exemplary embodiment, two rollers 220 are rotatably disposed on opposite end portions of a foot 230 of the carriage support member 210. The rollers 220 at each end of the carriage support member 210 are rotatably supported and guided along a common roller guide 150 disposed along the first and second lateral support members 110 and 120. In the exemplary embodiment each roller guide 150 includes upper and lower guide member 152 and 154 and a lower roller plate 156 disposed on the lower guide member 154. The roller guides 150 disposed along the transverse support members 110 and 120 are substantially parallel to each other. Each roller 220 includes an outer flange portion 224 that cooperates with inner side surfaces of the first and second guide members 152 and 154 for preventing derailment of the rollers 220 from the roller guides 150.

In the exemplary configuration of FIG. 2, the carriage 200 is reciprocatably translatable along the first and second lateral support members 110 and 120 by a first rotatable belt 240 fixedly coupled to the carriage 200 and rotatable coupled to first and second rotatable members 250 and 252 disposed upon opposite sides of the carriage 200. A second rotary drive member 260 is coupled to the first rotatable belt 240, and is operable to rotate the belt 240 in first and second opposite directions so as to reciprocatably translate the carriage 200 back and forth along the first and second lateral support members 110 and 120. Some applications, including the exemplary embodiment, include a second rotatable belt 242 also fixedly coupled to the carriage 200 and rotatably coupled to the first and second rotatable members 250 and 252 disposed on opposite sides of the carriage 200. In one configuration, the first rotatable member 250 is a first rotatable drive shaft rotatably coupled to the overhead frame 100 in a fixed location on a first side of the carriage 200, and the second rotatable member 252 is a second rotatable idler shaft rotatably coupled to the overhead frame 100 in a fixed location on a second side of the carriage 200. The second rotary drive member 260 is coupled to the first and second rotatable belts 240 and 242 by a gear box 262 and a drive belt 264 assembly. The second rotary drive member 260 is mounted on a mounting plate 142 coupled to one of the cross support members 140 of the overhead frame 100 proximate the first rotatable member 250.

According to another aspect of the invention, the carriage 200 and film wrapping apparatus 300 are incrementally and reciprocatably translatable back and forth along the overhead frame 100 in either direction so as to accurately position the film wrapping apparatus as discussed further below. In one embodiment, the second rotary drive member 260 is a motor operable in first and second reversible directions, and in another embodiment includes an AC inverter controlled electric motor, which permits variable speeds and reversible operation. In one embodiment, corresponding sensors 190 located near the rotatable drive shaft 250 and the rotatable idler shaft 252 measure shaft rotation generated signals upon detecting one or more tabs protruding radially from the respective shafts 250, 252. The generated signals are indicative of shaft rotation, which is related proportionally to carriage 200 translation along the overhead frame 100. The signals generated by the sensors 190 are usable to control or actuate the second rotary drive member 260 to position the carriage 200 and the film wrapping apparatus 300 along the overhead frame 100. In one embodiment, the second rotary drive member 260 is controllable by a programmable logic controller, or PLC. In one configuration, eight substantially equally spaced radial tabs protrude from each shaft 250, 252 wherein eight generated signals correspond to a single shaft rotation, which provides relatively accurate positioning of the carriage 200 along the overhead frame 100.

Figure 3:
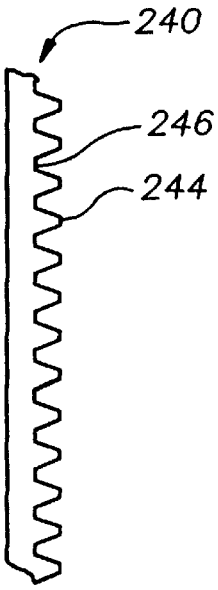
FIG. 3 is a partial side view of a drive belt useable to reciprocatingly translate a carriage and film wrapping apparatus according to an exemplary embodiment of the invention.

The exemplary embodiment of FIG. 3 shows partially the rotatable belt 240, substantially identical to belt 242, including a toothed surface 244 defined by recesses 246 disposed along an inner surface of the rotatable belt 240. The toothed surface 244 of the first and second rotatable belts 240, 242 are engageable with a corresponding complementary toothed first cog 263 coupled to the first rotatable member 250 and are also engageable with a corresponding complementary toothed second cog 265 coupled to the second rotatable member 252. The drive belt 264 of the second rotary drive member 260 may have a similarly toothed inner surface engageable with complementary toothed cogs on the output of the gear box 262 and on the first rotatable member 250. The cooperative combination of toothed surfaces on the various belts and the complementary toothed cogs provides accurate translational movement and positioning of the carriage 200 along the overhead frame 100 in response to the output of the second rotary drive member 260, and substantially eliminates any slippage between the output of second rotary drive member 260, the cogs and the belts.

Figure 4B:
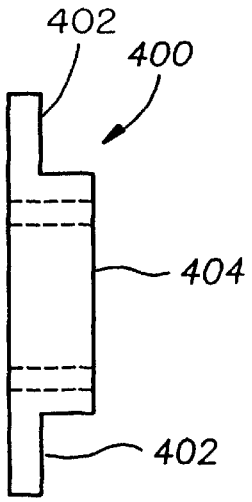
FIG. 4*b* is a side elevational view of the mounting bracket of FIG. 4*a*.
Figure 4A:
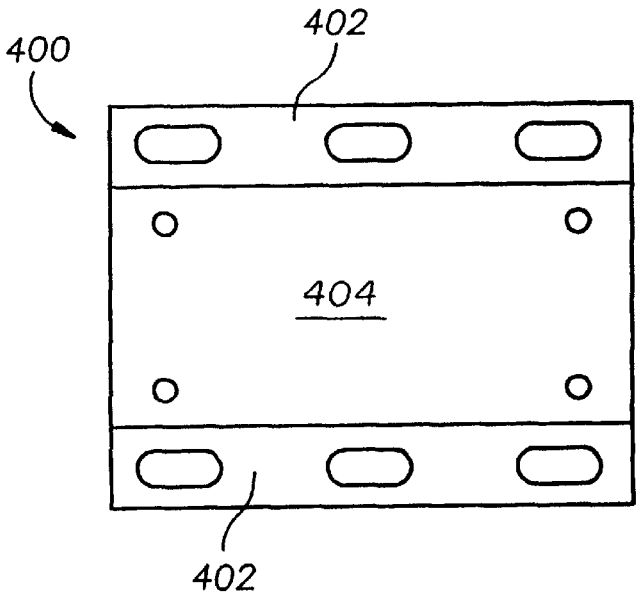
FIG. 4*a* is a plan view of a mounting bracket useable for mounting a drive belt to the carriage.
Figure 5A:
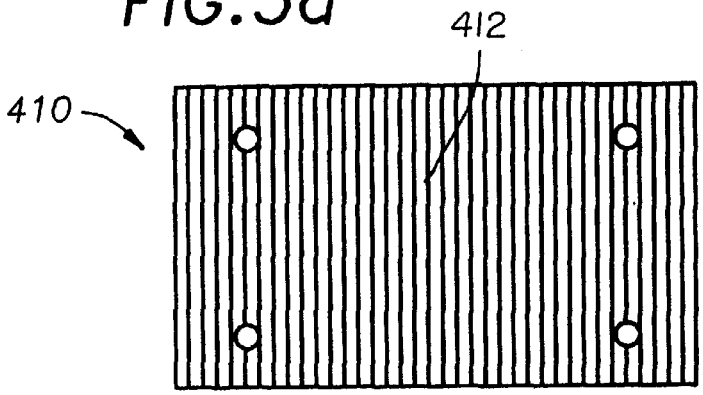
FIG. 5*a* is a plan view of a mounting bracket cover useable for retaining the drive belt of FIG. 3 on a mounting bracket.
Figure 5B:
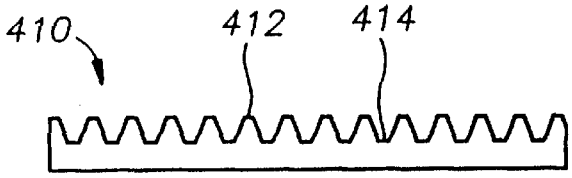
FIG. 5*b* is a side elevational view of the mounting bracket cover of FIG. 5*a*.

FIG. 4 is a mounting bracket 400 and FIG. 5 is a cover 410 which form an assembly useable for mounting a corresponding one of the first and second rotatable belts 240 and 242 to the carriage 200. The bracket 400 is seatable on a surface of the carriage support member 210 by welding, or by bolts or other fastening members disposed through apertures in lateral flanges 402, and includes a raised mounting surface 404 on which a portion of the rotatable belt is seated. The cover 410 is disposable over the portion of the rotatable belt seated on the mounting bracket 400, and retained by bolts or other fastening members disposed through the cover 410, through the rotatable belt portion and into the mounting bracket 400 so as to clamp the rotatable belt therebetween. In the exemplary embodiment of FIGS. 5*a* and 5*b*, the cover 410 includes a toothed surface 412 defined by recesses 414 for engaging and retaining a portion of the complementary toothed surface 244 of the rotatable belts 240 and 242 clamped between the cover 410 and the mounting bracket 400, which substantially eliminates any slippage between the rotatable belts 240, 242 and the carriage 200.

The film wrapping apparatus 300 includes generally a rotary arm 310 rotatably coupled to the carriage 200, and a wrapping carriage 320 disposed on a dependent member 330 extending downwardly from an end portion 312 of the rotary arm 310. The wrapping carriage 320 dispenses a film, such as a shrink or stretch film, which is wrapped about a load as the wrapping carriage 320 orbits a load positioned below the rotary arm 310. In one application, the wrapping carriage 320 is translatable upwardly and downwardly along the vertical member 330 as the wrapping carriage 320 orbits the load, and in other applications the wrapping carriage 320 is stationary along the vertical member 330. The film wrapping apparatus 300 also includes a first rotary drive member 340 actuatable for intermittently rotating the rotary arm 310 in rotational increments discussed further below. A film wrapping apparatus having this general structural configuration and suitable for use in the present application is, for example, a Cobra™ spiral film wrapping machine available from ITW Mima, an Illinois Tool Works Company, Boca Raton, Fla.

According to another aspect of the invention, the first rotary drive member 340 is intermittently actuatable for rotating the rotary arm 310 in angular rotational increments between and during back and forth translations of the carriage 200 and film wrapping apparatus 300 along the first and second lateral support members 110 and 120 so as to orbit the wrapping carriage 320 about a load. In one configuration, the first rotary drive member 340 is an electric motor with a regenerative drive for providing a braking effect as the rotary arm 310 and the wrapping carriage 320 approach an end of a desired angular rotational increment, and an electromagnetic brake for positively stopping the rotary arm 310 and the wrapping carriage 320 at the end of the desired angular rotational increment. The regenerative drive and electromagnetic brake provide for accurate positioning of the wrapping carriage 320 about the load during the film wrapping procedure. The rotation of the first rotary drive member 340 may be detected with a sensor disposed near radial tabs protruding from a rotating portion of the first rotary drive member 340, and the first rotary drive member 340 may be controlled as discussed above with respect to the second rotary drive member 260 and the rotatable drive and idler shafts 250, 252.

According to one mode of operation, a load is positioned below the overhead frame 100, the first rotary drive member 340 is intermittently actuatable for rotating the rotary arm 310 in approximately 180 degree rotational increments between back and forth translations of the carriage 200 along the first and second lateral support members 110 and 120, wherein the wrapping carriage 320 is orbital in a substantially oval path about a load disposed below the overhead frame 100. According to this mode of operation, the carriage 200 and film wrapping apparatus 300 are translated toward a first end of the overhead frame 100 corresponding to a first end portion of the load, and the rotary arm 310 is rotated in an approximately 180 degree rotational increment to orbit the wrapping carriage 320 about the first end portion of the load substantially along its minor dimension. The carriage 200 and film wrapping apparatus 300 are then translated along the major dimension of the load toward a second opposite end of the overhead frame 100, corresponding to a second opposite end portion of the load, whereupon the rotary arm 310 is again rotated in an approximately 180 degree rotational increment to orbit the wrapping carriage 320 about the second end portion of the load substantially along its minor dimension.

According to another mode of operation, the wrapping carriage 320 is movable in a substantially linear path along end portions of the load between the first and second lateral support members 110 and 120 as the wrapping carriage 320 is moved about the end portions of the load, wherein the path of the wrapping carriage 320 may also be substantially perpendicular to the first and second lateral support members 110 and 120 as the wrapping carriage 320 is moved about the end portions of the load. According to this mode of operation, the carriage 200 is translated away from the end portion of the load as the rotary arm 310 is moved between approximately 0 degrees and approximately 90 degrees, and the wrapping carriage 320 is translated toward the end portion of the load as the rotary arm 310 is moved between approximately 90 degrees and approximately 180 degrees. The wrapping carriage 320 is thus orbited in a substantially rectangular path about the elongated load.

According to yet another mode of operation, the rotation of the rotary arm 310 is slowed or braked as the rotary arm 310 approaches an end of its rotational increment, wherein the motion of the wrapping carriage 320 is correspondingly braked to permit accurate positioning of the wrapping carriage 320. The rotation of the rotary arm 310 is also positively stopped to permit more accurate positioning of the wrapping carriage 320. In the exemplary embodiments, the rotary arm 310 is slowed or braked as it approaches an end of the approximately 180 degree rotational increment by the regenerative drive discussed above, and the rotary arm 310 is positively braked as after rotating the approximately 180 degree rotational increment by the electromagnetic brake as discussed above.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A gantry film wrapping system useable for wrapping film about an elongated load, comprising:

an overhead frame having a first lateral support member and a second lateral support member;

a carriage having opposite end portions respectively supported by said first and second lateral support members;

film wrapping apparatus comprising a rotary arm rotatably mounted at one end thereof upon said carriage, and a film wrapping carriage mounted upon a second end of said rotary arm; and means for driving said carriage in a reciprocating translational mode back and forth along said first and second lateral support members of said overhead frame during a film wrapping operation whereby said film wrapping carriage is movable in a substantially oval orbit about an elongated load disposed at a wrapping station below said overhead frame.

2. The system of claim 1 further comprising a first rotary drive member intermittently actuatable for rotating the rotary arm in approximately 180 degree rotational increments between back and forth translations of the carriage along the first lateral support member and the second lateral support member of the overhead frame.

3. The system of claim 2 further comprising a regenerative drive for braking the first rotary drive member as the rotary arm approaches the end of an approximately 180 degree rotational increment, and a brake for positively stopping the first rotary drive member after the rotary arm has rotated through an approximately 180 degree rotational increment.

4. The system of claim 1 wherein the carriage includes a carriage support member disposed transversely between the first lateral support member and the second lateral support member, at least one roller disposed on each opposite end portion of the carriage support member, the roller on each end portion of the carriage support member rotatably supported by a roller guide disposed along the first lateral support member and the second lateral support member.

5. The system of claim 1 further comprising:

a first rotatable belt fixedly coupled to the carriage, the first rotatable belt rotatably coupled to a first rotatable member and to a second rotatable member, the first rotatable member and the second rotatable member disposed on opposite sides of the carriage, and a second rotary drive member coupled to the first rotatable belt, wherein the second rotary drive member is operable to rotate the first rotatable belt in opposite directions so as to reciprocatably translate the carriage back and forth along the first lateral support member and the second lateral support member.

6. The system of claim 5 wherein the first rotatable belt has a toothed surface engageable with a first complementary toothed cog coupled to the first rotatable member and engageable with a second complementary toothed cog coupled to the second rotatable member, the first rotatable belt fixedly coupled to the carriage between a mounting bracket and cover assembly with a complementary toothed surface engageable with the toothed surface of the first rotatable belt.

7. The system of claim 5 further comprising a second rotatable belt fixedly coupled to the carriage, the second rotatable belt rotatably coupled to the first rotatable member and to the second rotatable member, wherein the first rotatable member is a first rotatable drive shaft disposed on a first side of the carriage and the second rotatable member is a second rotatable idler shaft disposed on a second side of the carriage.

8. The system of claim 5 wherein the second rotary drive member is a variable speed electric motor operable in reversible directions, wherein the variable speed electric motor is coupled to the first rotatable belt so as to translate the carriage back and forth along the first lateral support member and the second lateral support member of the overhead frame at variable speeds.

9. A method of wrapping a film, about a load having first and second opposite ends, by a film wrapping apparatus having a film wrapping carriage coupled to an end portion of a rotary arm, comprising the steps of:

supporting the rotary arm of the film wrapping apparatus by a carriage having opposite end portions supported by a first lateral support member and a second lateral support member of an overhead frame; and translating the carriage of the film wrapping apparatus back and forth in a reciprocating manner along the first lateral support member and the second lateral support member of the overhead frame while rotating the rotary arm in rotational increments between back and forth translations of the carriage along the first lateral support member and the second lateral support member of the overhead frame so as to move the film wrapping carriage along side portions of the load and about end portions of the load in a substantially oval orbit.

10. The method of claim 9, further comprising the steps of:

translating the carriage away from an end portion of the load as the rotary arm moves the film wrapping carriage between approximately 0 degrees and approximately 90 degrees; and translating the carriage toward said end portion of the load as the rotary arm moves the film wrapping carriage between approximately 90 degrees and approximately 180 degrees whereby the film wrapping carriage is moved in a substantially linear path along said end portion of the load.

11. The system as set forth in claim 7, further comprising:

sensor means disposed adjacent to said first rotatable drive shaft for sensing rotational positions of said first rotatable drive shaft and for generating control signals, in response to said sensed rotational positions of said first rotatable drive shaft, for controlling operation of said second rotary drive member.

12. The system as set forth in claim 1, wherein:

said rotary arm is rotatably disposed within a horizontal plane; and said film wrapping carriage is mounted upon a vertically extending support member, mounted upon said second end of said rotary arm, so as to be reciprocably movable within a vertical plane along said vertically extending support member.

13. The method as set forth in claim 9, further comprising the steps of:

mounting said film wrapping carriage upon a vertical support member extending downwardly from said end portion of said rotary arm; and moving said film wrapping carriage in a vertically reciprocating manner along said vertical support member.

14. The method as set forth in claim 9, further comprising the step of:

providing drive belt means for translating said carriage of said film wrapping apparatus back and forth in said reciprocating manner along said first and second lateral support members of said overhead frame.

15. The method as set forth in claim 14, further comprising the step of:

providing first and second drive belts as said drive belt means, wherein said first and second drive belts are connected to opposite end portions of said carriage.

16. The method as set forth in claim 15, further comprising the steps of:

routing said first and second drive belts around first and second drive and idler shafts; and operatively connecting a motor drive to said first drive shaft for rotating said first drive shaft.

17. The method as set forth in claim 16, further comprising the steps of:

providing a rotary shaft sensor adjacent to said first drive shaft for sensing rotary shaft positions of said first drive shaft and for generating control signals indicative of said rotary shaft positions of said first drive shaft; and operatively connecting said rotary shaft sensor to said motor drive so as to control said motor drive in accordance with said control signals indicative of said rotary shaft positions of said first drive shaft.

* * * * *